US007487648B2

(12) United States Patent
Weber et al.

(10) Patent No.: US 7,487,648 B2
(45) Date of Patent: Feb. 10, 2009

(54) CRYOGENIC AIR SEPARATION METHOD WITH TEMPERATURE CONTROLLED CONDENSED FEED AIR

(75) Inventors: Joseph Alfred Weber, Cheektowaga, NY (US); M. Mushtaq Ahmed, Pittsford, NY (US); Todd Alan Skare, Shanghai (CN); Neil Mark Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 352 days.

(21) Appl. No.: 11/372,098

(22) Filed: Mar. 10, 2006

(65) Prior Publication Data

US 2007/0209388 A1 Sep. 13, 2007

(51) Int. Cl.
*F25J 3/00* (2006.01)

(52) U.S. Cl. ..... 62/646; 62/643

(58) Field of Classification Search ..... 62/643, 62/646
See application file for complete search history.

(56) References Cited

U.S. PATENT DOCUMENTS

| | | | | |
|---|---|---|---|---|
| 4,303,428 | A | 12/1981 | Vandenbussche | 62/13 |
| 4,732,595 | A * | 3/1988 | Yoshino | 62/654 |
| 4,968,337 | A | 11/1990 | Layland et al. | 62/24 |
| 5,426,947 | A | 6/1995 | Grenier | 62/25 |
| 5,471,843 | A | 12/1995 | Chretien | 62/36 |
| 5,829,271 | A | 11/1998 | Lynch et al. | 62/646 |
| 6,293,126 | B1 | 9/2001 | Higginbotham | 62/646 |
| 6,357,259 | B1 * | 3/2002 | Higginbotham et al. | 62/656 |
| 2005/0126221 | A1 * | 6/2005 | Ha et al. | 62/643 |
| 2006/0277944 | A1 * | 12/2006 | Le Bot et al. | 62/646 |

* cited by examiner

*Primary Examiner*—William C Doerrler
(74) *Attorney, Agent, or Firm*—David M. Rosenblum

(57) ABSTRACT

A method for the cryogenic separation of air having defined temperatures for condensed feed air passed into a double column system relative to liquid oxygen and preferably to shelf vapor, and wherein kettle liquid is not subcooled from the higher pressure column to the lower pressure column.

4 Claims, 2 Drawing Sheets

CRYOGENIC AIR SEPARATION METHOD WITH TEMPERATURE CONTROLLED CONDENSED FEED AIR

TECHNICAL FIELD

This invention relates generally to cryogenic air separation and, more particularly, to cryogenic air separation employing a double column and wherein at least some feed air is condensed prior to passage into one or both of the columns.

BACKGROUND ART

Cryogenic air separation is a very energy intensive process because of the need to generate low temperature refrigeration to drive the process. Accordingly, any method which improves the utilization of the available refrigeration in carrying out cryogenic air separation would be very desirable.

SUMMARY OF THE INVENTION

A method for carrying out cryogenic air separation employing a double column having a higher pressure column and a lower pressure column comprising:

(A) condensing feed air, passing the condensed feed air into the higher pressure column, and separating feed air within the higher pressure column by cryogenic rectification to produce nitrogen-enriched vapor and oxygen-enriched liquid;

(B) withdrawing nitrogen-enriched vapor from the higher pressure column, withdrawing oxygen-enriched liquid from the higher pressure column, and passing oxygen-enriched liquid withdrawn from the higher pressure column into the lower pressure column without undergoing subcooling; and (C) producing nitrogen-rich vapor and oxygen-rich liquid by cryogenic rectification within the lower pressure column, and withdrawing oxygen-rich liquid from the lower pressure column wherein the temperature of the condensed feed air exceeds the temperature of the oxygen-rich liquid withdrawn from the lower pressure column.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. A double column comprises a higher pressure column having its upper end in heat exchange relation with the lower end of a lower pressure column.

Vapor and liquid contacting separation processes depend on the difference in vapor pressures for the components. The higher vapor pressure (or more volatile or low boiling) component will tend to concentrate in the vapor phase whereas the lower vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "feed air" means a mixture comprising primarily oxygen, nitrogen and argon, such as ambient air.

As used herein, the terms "upper portion" and "lower portion" of a column mean those sections of the column respectively above and below the mid point of the column.

As used herein, the terms "turboexpansion" and "turboexpander" mean respectively method and apparatus for the flow of high pressure fluid through a turbine to reduce the pressure and the temperature of the fluid, thereby generating refrigeration.

As used herein, the term "cryogenic air separation plant" means the column or columns wherein feed air is separated by cryogenic rectification to produce nitrogen, oxygen and/or argon, as well as interconnecting piping, valves, heat exchangers and the like.

As used herein, the term "compressor" means a machine that increases the pressure of a gas by the application of work.

As used herein, the term "subcooling" means cooling a liquid to be at a temperature lower than the saturation temperature of that liquid for the existing pressure.

DETAILED DESCRIPTION

Figure 1:
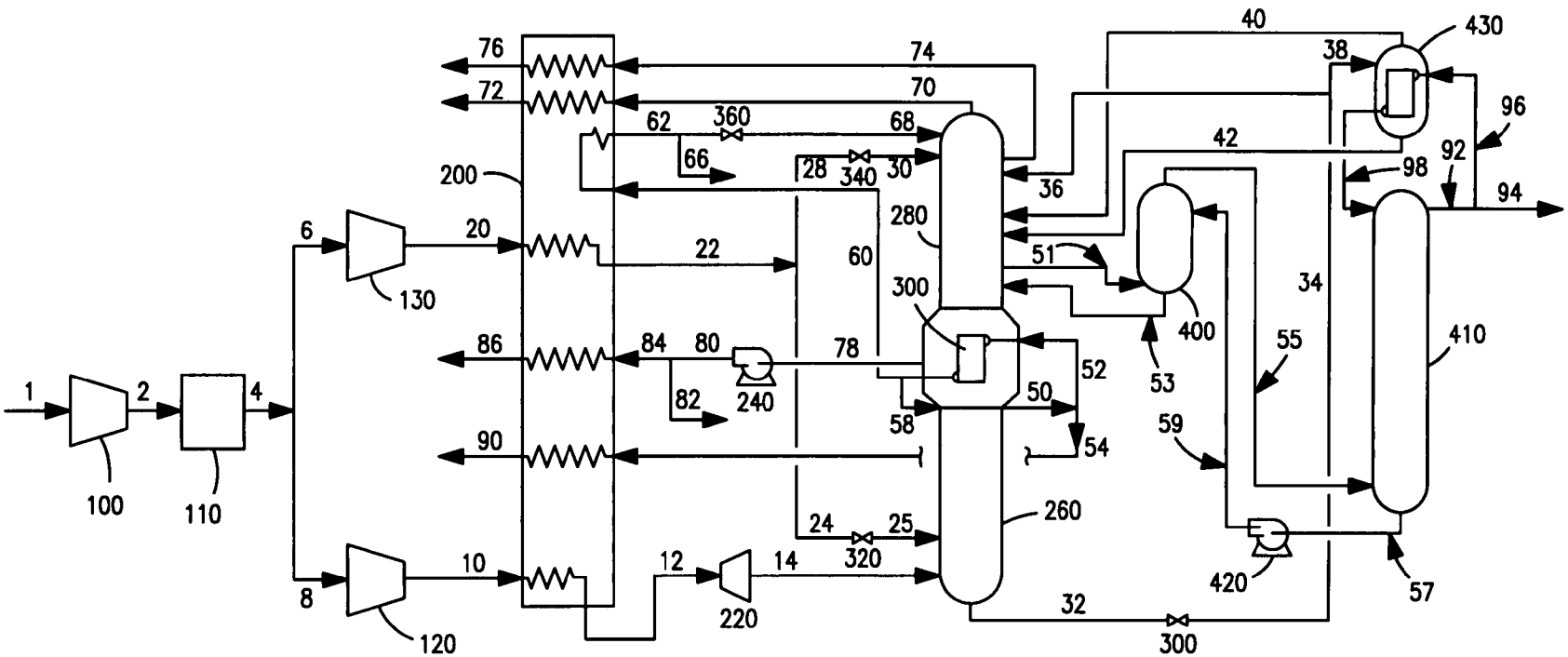
FIG. 1 is a schematic representation of one preferred arrangement for the practice of the cryogenic air separation method of this invention.

The invention will be described in greater detail with reference to the Drawings. The cryogenic air separation plant illustrated in the Drawings comprises a double column, having a higher pressure column 260 and a lower pressure column 280, a low ratio argon column 400, and a super-staged argon column 410.

Referring now to FIG. 1, feed air 1 is compressed in compressor 100 and compressed feed air stream 2 is cleaned of high boiling impurities in purifier 110. Resulting cleaned, compressed feed air 4 is divided into stream 6 and stream 8. Feed air stream 6 is further compressed in compressor 130 and resulting feed air stream 20 is passed into main heat exchanger 200 wherein it is condensed by indirect heat exchange with return streams such as pumped liquid oxygen, and from which it emerges as condensed feed air stream 22 having a temperature generally within the range of from 92K to 105K, preferably within the range of from 93.5K to 102K.

Condensed feed air 22 is divided into a first condensed feed air stream 24, which is at a temperature essentially the same as that of stream 22 and which is passed through valve 320 and as stream 25 into higher pressure column 260, and into a second condensed feed air stream 28 which is passed through valve 340 and as stream 30 into lower pressure column 280. Feed air stream 8 is further compressed by passage through compressor 120 and resulting feed air stream 10 is cooled by indirect heat exchange with return streams in main heat exchanger 200 to form third feed air stream 12. Third feed air stream 12 is turboexpanded by passage through turboexpander 220 to generate refrigeration bearing third feed air stream 14 having a temperature generally within the range of from 99K to 117K. The temperature of condensed feed air stream 24 does not exceed the temperature of turboexpanded third feed air stream 14. Turboexpanded third feed air stream 14 is passed into the lower portion of higher pressure column 260.

Within higher pressure column 260 the feed air is separated by cryogenic rectification in nitrogen-enriched vapor and oxygen-enriched liquid. Nitrogen-enriched vapor is withdrawn from the upper portion of higher pressure column 260 as stream 50 having a temperature generally within the range of from 94K to 96K. Preferably, the temperature of the condensed feed air stream 24 which is ultimately passed into the higher pressure column exceeds the temperature of the nitrogen-enriched vapor in stream 50 withdrawn from the higher pressure column. A portion 54 of stream 50 may be warmed in main heat exchanger 200 and recovered as higher pressure nitrogen product 90. The remaining portion 52 of the withdrawn nitrogen-enriched vapor is condensed by indirect heat exchange with lower pressure column 280 bottom liquid in main condenser 300. A portion 58 of the resulting condensed nitrogen-enriched liquid is returned to higher pressure column 260 as reflux. Another portion 60 of the resulting condensed nitrogen-enriched liquid is subcooled in main heat exchanger 200. Resulting subcooled nitrogen-enriched liquid 62 is passed through valve 360 and as stream 68 into the upper portion of lower pressure column 280. If desired, a portion 66 of stream 62 may be recovered as liquid nitrogen product.

Oxygen-enriched liquid is withdrawn from the lower portion of higher pressure column 260 in stream 32, passed through valve 300 and then passed into lower pressure column 280 without undergoing any subcooling. In the illustrated embodiments the cryogenic air separation plant also includes argon production. In these embodiments the oxygen-enriched liquid 34 from valve 300 is divided into stream 36, which as previously described is passed without subcooling into lower pressure column 280, and into stream 38 which is passed into argon column top condenser 430 for processing as will be further described below.

Within lower pressure column 280 the various feeds are separated by cryogenic rectification into nitrogen-rich vapor and oxygen-enriched liquid. Nitrogen-rich vapor is withdrawn from the upper portion of lower pressure column 280 in stream 70, warmed by passage through main heat exchanger 200, and recovered as gaseous nitrogen product in stream 72. For product purity control purposes waste nitrogen stream 74 is withdrawn from column 280 below the withdrawal level of stream 70, and after passage through heat exchanger 200 is removed from the process in stream 76. Oxygen-rich liquid is withdrawn from the lower portion of lower pressure column 280 in stream 78 having a temperature generally within the range of from 93K to 95K. The temperature of the condensed feed air stream 24 which is ultimately passed into the higher pressure column exceeds the temperature of the oxygen-rich liquid in stream 78 withdrawn from the lower pressure column. Stream 78 is pumped to a higher pressure by cryogenic liquid pump 240 to form pressurized liquid oxygen stream 80. If desired, a portion 82 of stream 80 may be recovered as liquid oxygen product. The remaining portion 84 is vaporized by passage through main heat exchanger 200 by indirect heat exchanger with incoming feed air and recovered as gaseous oxygen product in stream 86.

A stream comprising primarily oxygen and argon is passed in stream 51 from column 280 into low ratio argon column 400 wherein it is separated into argon-enriched top vapor and oxygen-richer bottom liquid which is returned to column 280 in stream 53. The argon-enriched top vapor is passed into superstaged argon column 410 in stream 55 wherein it undergoes cryogenic rectification to produce argon top vapor and argon-depleted liquid which is withdrawn from column 410 in stream 57 and pumped by pump 420 into the upper portion of column 400 in stream 59. Argon top vapor is withdrawn from column 410 in stream 92 and a portion 94 is recovered as product argon. Another portion 96 is condensed in argon top condenser 430 against partially vaporizing oxygen-enriched liquid provided to top condenser 430 in stream 38. The resulting condensed argon is returned to column 410 in stream 98 as reflux. The resulting oxygen-enriched fluid from top condenser 430 is passed into lower pressure column 280 in vapor stream 40 and liquid stream 42.

Figure 2:
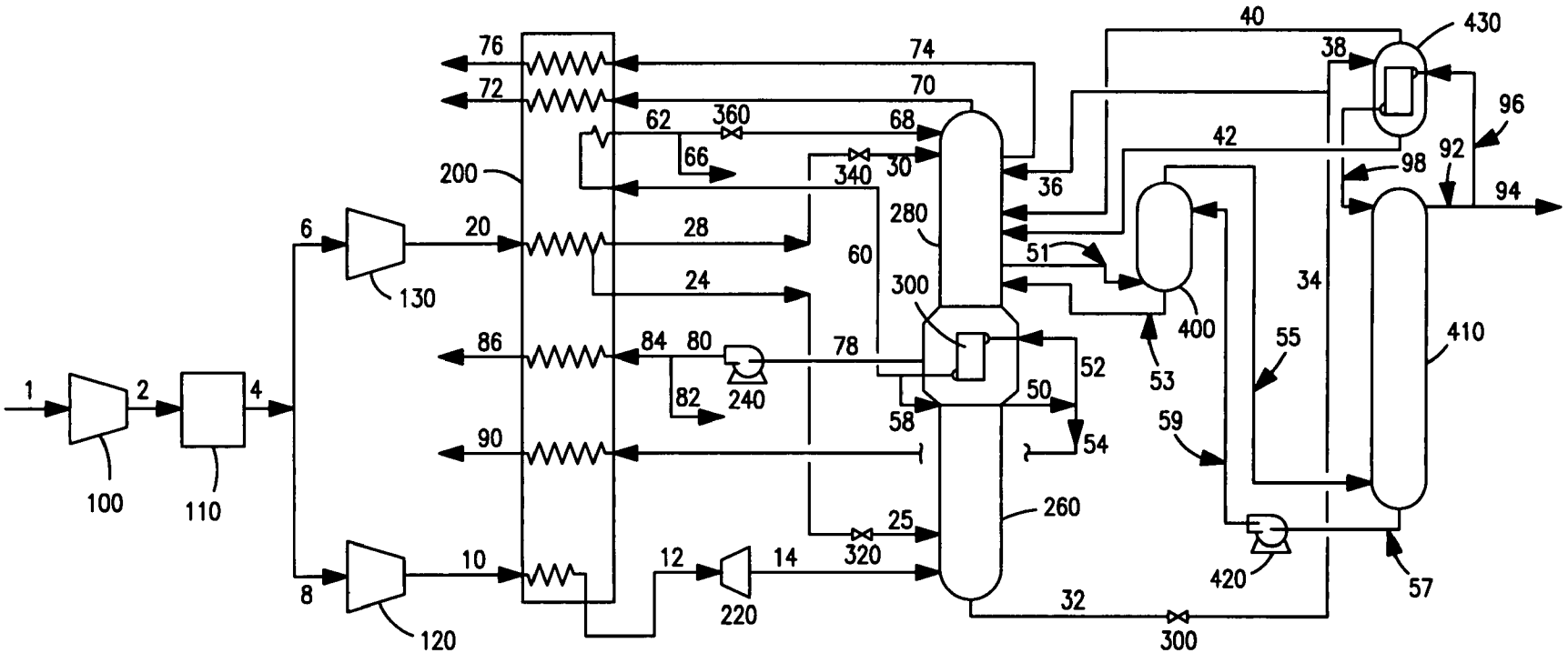
FIG. 2 is a schematic representation of another preferred arrangement for the practice of the cryogenic air separation method of this invention.

In the embodiment of the invention illustrated in FIG. 2, the numerals are the same as those shown in FIG. 1 for the common elements, and these common elements will not be described again in detail. Referring now to FIG. 2, the second condensed feed air stream 28 undergoes further cooling than does the condensed feed air stream which is passed into the higher pressure column and thus is at a colder temperature than this stream. Moreover, the second condensed feed air stream which is passed into the lower pressure column is at a temperature which does not exceed the temperature of the nitrogen-enriched vapor withdrawn from the higher pressure column.

Although the invention has been described in detail with reference to certain preferred embodiments, those skilled in the art will recognize that there are other embodiments of the invention within the spirit and the scope of the claims.

The invention claimed is:

1. A method for carrying out cryogenic air separation employing a double column having a higher pressure column and a lower pressure column comprising:

(A) condensing feed air to produce condensed feed air, passing a stream of the condensed feed air into the higher pressure column, and separating the feed air contained within the stream of the condensed feed air within the higher pressure column by cryogenic rectification to produce nitrogen-enriched vapor and oxygen-enriched liquid;

(B) withdrawing nitrogen-enriched vapor from the higher pressure column, withdrawing oxygen-enriched liquid from the higher pressure column, and passing oxygen-enriched liquid withdrawn from the higher pressure column into the lower pressure column without undergoing subcooling; and (C) producing nitrogen-rich vapor and oxygen-rich liquid by cryogenic rectification within the lower pressure column, and withdrawing oxygen-rich liquid from the lower pressure column wherein the temperature of the condensed feed air exceeds the temperature of the oxygen-rich liquid withdrawn from the lower pressure column and the temperature of the nitrogen-enriched vapor withdrawn from the higher pressure column.

2. The method of claim 1 wherein the stream of the condensed feed air passed into the higher pressure column is a first stream of the condensed feed air and a second stream of the condensed feed air is passed into the lower pressure column.

3. The method of claim 2 wherein the temperature of the second stream of condensed feed air which is passed into the lower pressure column does not exceed the temperature of the nitrogen-enriched vapor withdrawn from the higher pressure column.

4. The method of claim 1 further comprising turboexpanding part of the feed air to produce a turboexpanded feed air stream and passing the turboexpanded feed air stream into the higher pressure column wherein the stream of condensed feed air passed into the higher pressure column has a temperature which does not exceed the temperature of the turboexpanded feed air stream.

* * * * *